United States Patent [19]

Mize

[11] 3,949,907

[45] Apr. 13, 1976

[54] STORAGE BIN WITH LIQUID SEALED DISCHARGE OPENING

[75] Inventor: Erbie Gail Mize, Chattanooga, Tenn.

[73] Assignee: Astec Industries, Inc., Chattanooga, Tenn.

[22] Filed: Dec. 23, 1974

[21] Appl. No.: 535,286

[52] U.S. Cl. ..... 222/188; 137/248

[51] Int. Cl.[2] ..... B67D 3/00

[58] Field of Search ..... 222/188, 67, 542; 137/247, 137/248, 249, 250, 246, 246.23; 220/205, 217, 228; 277/135

[56] References Cited

UNITED STATES PATENTS 1,602,686 10/1926 Leet ..... 222/67

FOREIGN PATENTS OR APPLICATIONS 638,405 2/1928 France ..... 137/248

550,900 1/1943 United Kingdom ..... 220/228

*Primary Examiner*—Robert B. Reeves

*Assistant Examiner*—Francis J. Bartuska

*Attorney, Agent, or Firm*—Jones, Thomas & Askew

[57] ABSTRACT

Storage bin having a material discharge opening and a gate which is selectively openable to discharge material from the bin. A region surrounding the gated opening is selectively filled with a liquid to provide an airtight seal surrounding the closed discharge opening. The liquid is withdrawn from the region surrounding the discharge opening, before the gate is opened for discharge of material from the storage bin.

8 Claims, 5 Drawing Figures

STORAGE BIN WITH LIQUID SEALED DISCHARGE OPENING

This invention relates in general to storage bins and in particular to a storage bin having an improved airtight closure.

Storage bins or similar containers are used in a diverse number of applications for receiving, storing, and subsequently discharging fluent materials of various types. One such application of storage bins is frequently found in the manufacture of asphalt aggregate compositions of the kind used for paving materials. An asphalt aggregate manufacturing facility typically includes one or more storage bins into which the prepared asphalt aggregate mix is conveyed for temporary storage. A desired quantity of prepared asphalt aggregate mix can be discharged from a storage bin, from time to time, into a truck for transport to the actual site of paving operations.

Those skilled in the art of asphalt aggregate manufacture realize that asphalt aggregate mixtures are preferably maintained at an elevated temperature during storage, to ensure that the mix remains sufficiently fluent for effective gravity discharge from the storage bin, and for subsequent utilization. Asphalt aggregate mix is maintained at an elevated temperature within an asphalt storage bin by known techniques such as the use of conduits which are in heat-transfer connection to the storage bin, and through which flow a heating medium such as heated oil or the like. Further information on an asphalt mix storage bin of the prior art is found in U.S. Pat. No. 3,348,739.

It is recognized that asphalt aggregate mixtures tend to undergo oxidizing deterioration when subjected to an oxygen-containing atmosphere, and this unwanted oxidation is normally accelerated by storing the mix at an elevated temperature within a heated storage bin. The problem of asphalt mix oxidation within a storage bin has been partially overcome in the art by maintaining a nonoxidizing atmosphere within the empty portion of the bin, and by attempting to seal off the interior of the bin at all times other than when asphalt mix is being added or withdrawn from the bin. Airtight closure of such storage bins has generally required specialized sealing structure associated with the material entrance and exit openings of the bin, since an airtight seal cannot practicably be obtained with a clam gate or other flow control structure which is effective for controlling the discharge of asphalt mix from the bin. An example of a prior art storage bin with sealing structure is found in U.S. Pat. No. 3,532,252, wherein the material inlet and outlet gates of a bin are provided with airtight seals including enclosed sealing chambers which adjoin and selectively enclose the respective openings. Each sealing chamber has a separate mechanically-actuated air seal gate. Such sealing apparatus of the prior art includes complex hydraulic and electrical control interlock circuitry, and is expensive in construction and in maintenance.

Accordingly, it is an object of the present invention to provide a storage bin having an improved airtight seal for a material discharge opening.

It is another object of the present invention to provide an improved bin for storing asphalt aggregate mix.

It is still another object of the present invention to provide an improved airtight seal for sealing a material discharge gate of a storage bin.

Other objects and attendant advantages of the present invention will become more readily apparent from a review of the invention as contained in the disclosed embodiment, including the drawing in which.

Stated in general terms, airtight sealing of the discharge opening in a storage bin is accomplished according to the present invention by closing the gate of the discharge opening, and then immersing the gated opening with a quantity of liquid to provide an air-tight seal surrounding the opening at a time when material is not being discharged through the opening. The air sealing liquid is withdrawn from surrounding relation with the opening prior to intended material discharge.

Figure 1:
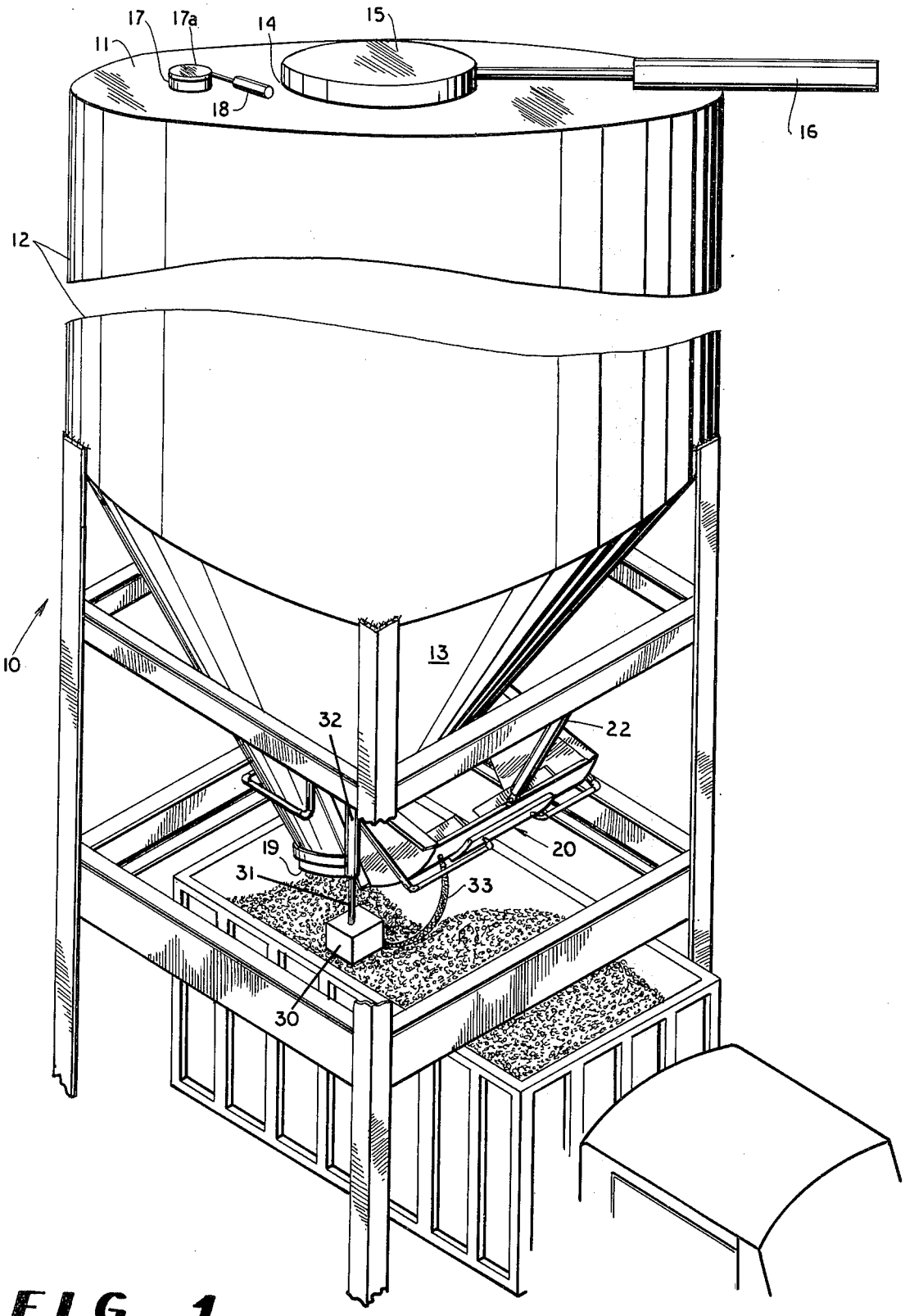
FIG. 1 shows a pictorial view of a storage bin equipped with sealing apparatus according to the disclosed embodiment of the present invention.

The present invention is now discussed with reference to the disclosed embodiment depicted in the Figures, wherein there is shown an asphalt storage bin indicated generally at 10 and including a top portion 11, a body portion 12, and a bottom portion 13 of generally conical shape. The top portion 11 has a material receiving top opening 14 through which asphalt mix or any other material is admitted to the interior of the bin. The material receiving opening 14 is provided with appropriate sealing gate apparatus 15 which is selectively operable by an actuator 16 to assume either a closed sealing position as depicted in FIG. 1, in which an airtight seal is maintained at the top opening 14, or an opened position in which opening 14 is unsealed and unobstructed. Suitable structure for selectively sealing the material receiving opening in the top of an asphalt mix storage bin is disclosed in pending U.S. Patent application No. 505,672, filed Sept. 13, 1974. It will be understood that the asphalt mix (or another desired material) being introduced to the storage bin 10 through the opening 14 is supplied by any suitable material moving apparatus. The top of the storage bin 10 is also provided with a vent opening 17 having a closure gate **17*a* which is selectively openable by the actuator 18**, for a purpose described below.

Figure 2:
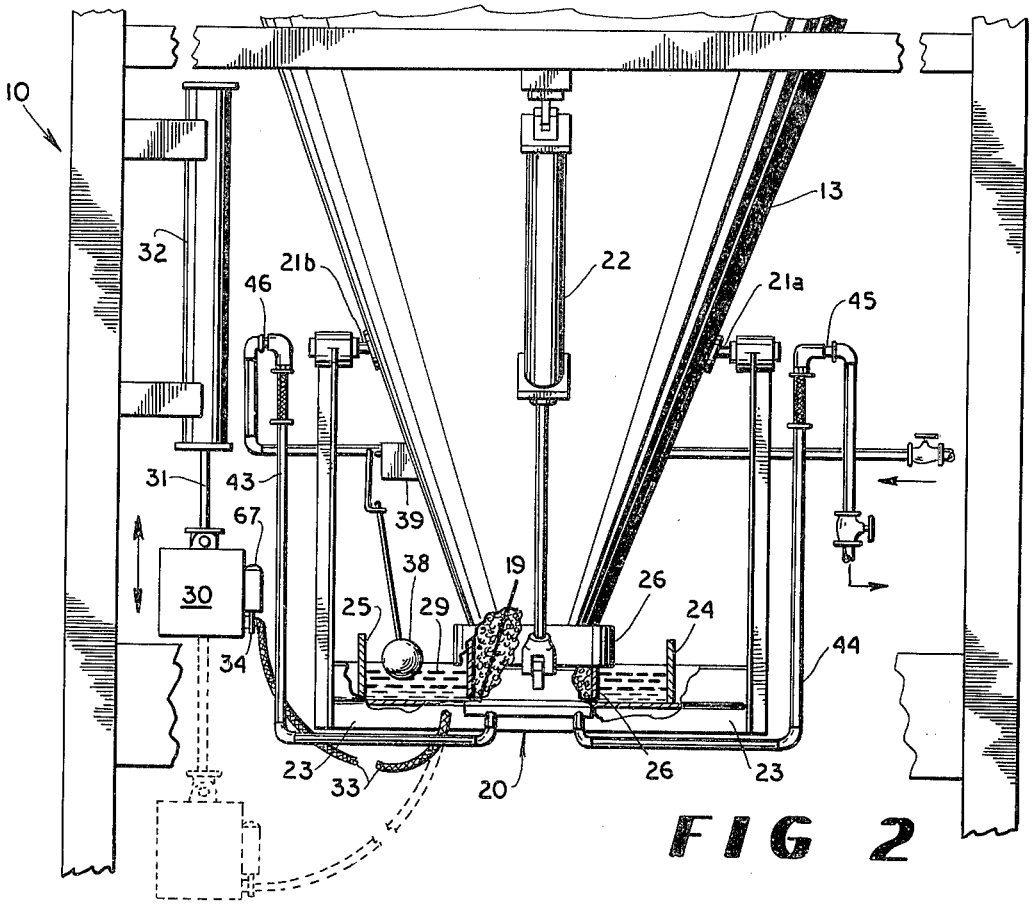
FIG. 2 is a fragmentary and partially broken-away elevation view showing the sealing apparatus of FIG. 1 in airtight sealing position.
Figure 3:
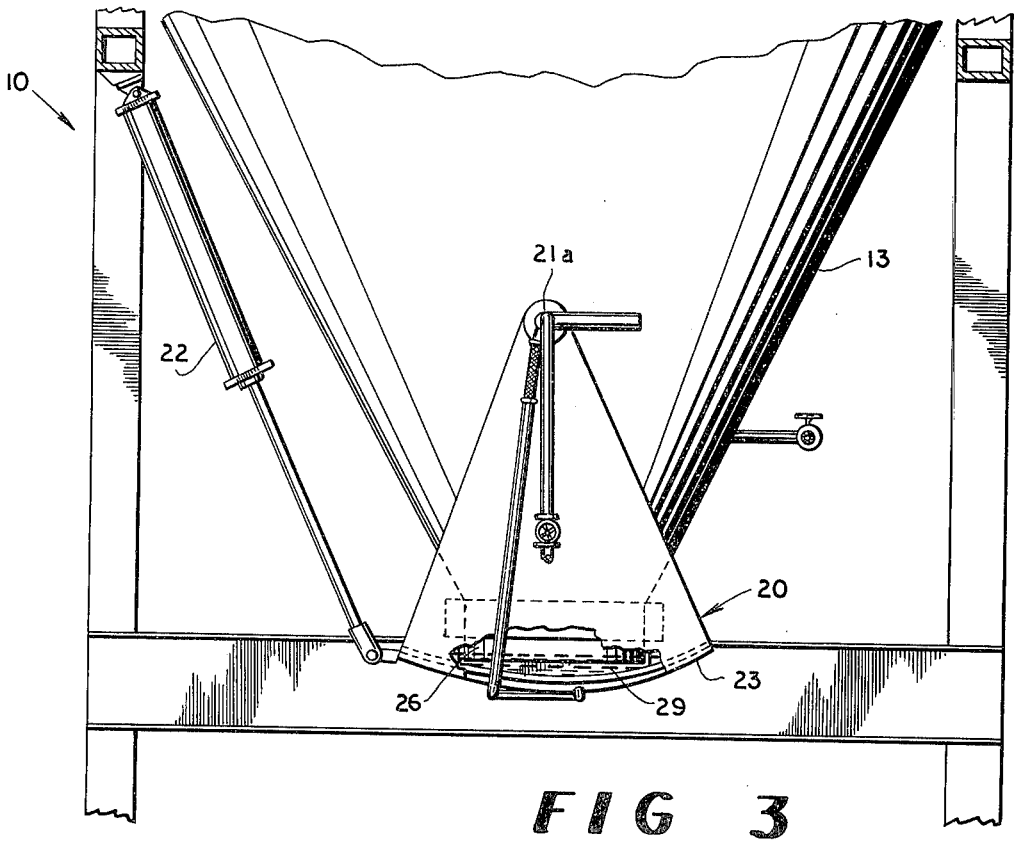
FIG. 3 is another fragmentary elevation view of the disclosed embodiment showing the disclosed apparatus in sealing operation.

The lowermost end of the bottom portion 13 of the storage bin is open as at 19 to provide a material discharge opening. A clam gate 20 is pivotally connected to the bin as at **21*a* and 21*b*, and a fluid-powered gate actuator 22 is connected to the clam gate. The clam gate 20 is movable either to a closed position, as shown in FIGS. 2 and 3, in which the clam gate substantially blocks the discharge opening 19, or to an open position as shown in FIG. 1 in which the clam gate is pivoted away from the discharge opening 19. It will be understood by those skilled in the art that material previously introduced to the storage bin 10 is gravitationally discharged from the bin through the discharge opening 19 when the clam gate 20 is in the open position shown in FIG. 1. It will also be understood that the closed position of the clam gate, while obstructing and terminating the discharge opening 19** to an extent which prevents the flow of material through the opening, is practicably incapable of establishing an airtight seal with the discharge opening.

Figure 4:
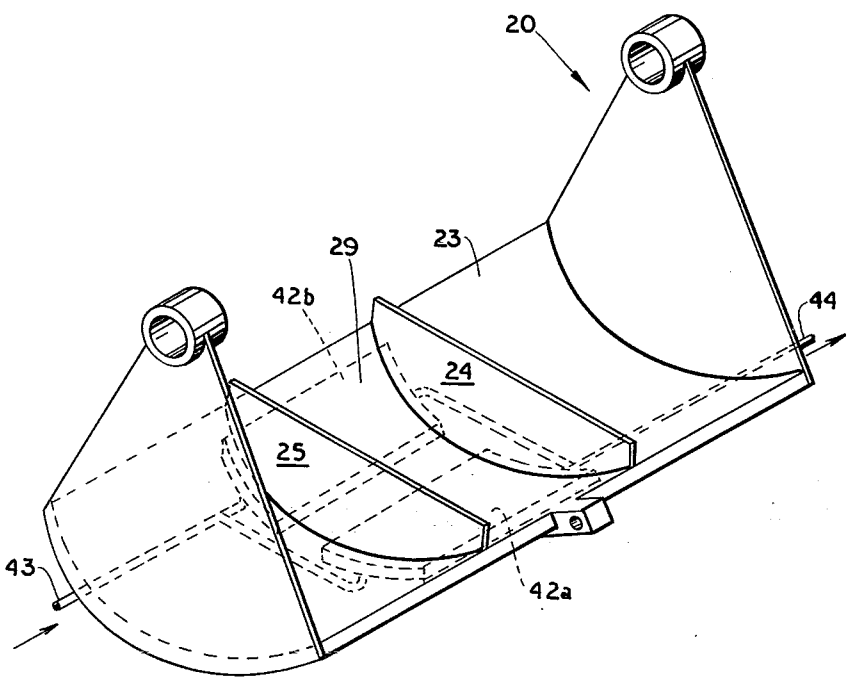
FIG. 4 is a detailed pictorial view showing the interior of the clam gate used in the disclosed embodiment.

The clam gate 20 includes a bottom member 23 which is generally arcuate in configuration. Attached to the upper surface of the bottom member 23, as by welding or the like, are a pair of upright plates 24 and 25 which are generally parallel to the path in which the clam gate 20 is moved by the gate actuator 22, and which are mutually spaced apart a distance sufficient to accommodate the outside diameter of the structure 26 which surrounds the material discharge opening 19. It is particularly evident from FIGS. 2 and 4 that the plates 24 and 25 define walls having an uppermost elevation which is above the material discharge opening 19 of the storage bin, when the clam gate 20 is in the closed position.

It is thus seen that the two plates 24 and 25, in cooperation with the bottom member 23 of the clam gate, provide a liquid receiving region 29 which can retain a quantity of liquid surrounding the material discharge opening 19. The apparatus for selectively admitting or withdrawing liquid from the region 29 includes the liquid reservoir 30 which is connected to the operating rod 31 of the fluid-powered liquid sealing actuator 32. The liquid reservoir 30 and the liquid sealing actuator 32 are positioned at an elevation which is proximately the same as the elevation of the clam gate 20. It is important to the operation of the disclosed embodiment that the liquid reservoir 30 be movable by the liquid sealing actuator 32 to assume either a lowered position (shown in broken line in FIG. 2) in which the liquid reservoir is positioned below the material discharge opening 19 in the bin 10, and to a raised position (shown in FIG. 1 and by solid line in FIG. 2) in which the liquid reservoir is above the material discharge opening 19.

The liquid reservoir 30 is connected to the liquid receiving region 29 within the clam gate by means of a flexible hose 33, and a liquid control valve 34 is connected in fluid flow circuit with the hose 33. The valve 34 is operated by a motor 67 for control of fluid through the hose, in a manner described below.

The level of liquid within the liquid receiving region 29 is monitored by a liquid level sensor including a float 38 which is mounted to extend into liquid-measuring relation within the region 29. The float 38 is connected to an electrical switch 39 which is operative to assume a first switching state when the liquid level sensed by the float 38 reaches a predetermined maximum level, and which operates to assume a second switching state when the sensed level of liquid in the region 29 is lowered to a level which is just above the material discharge opening 19.

Figure 5:
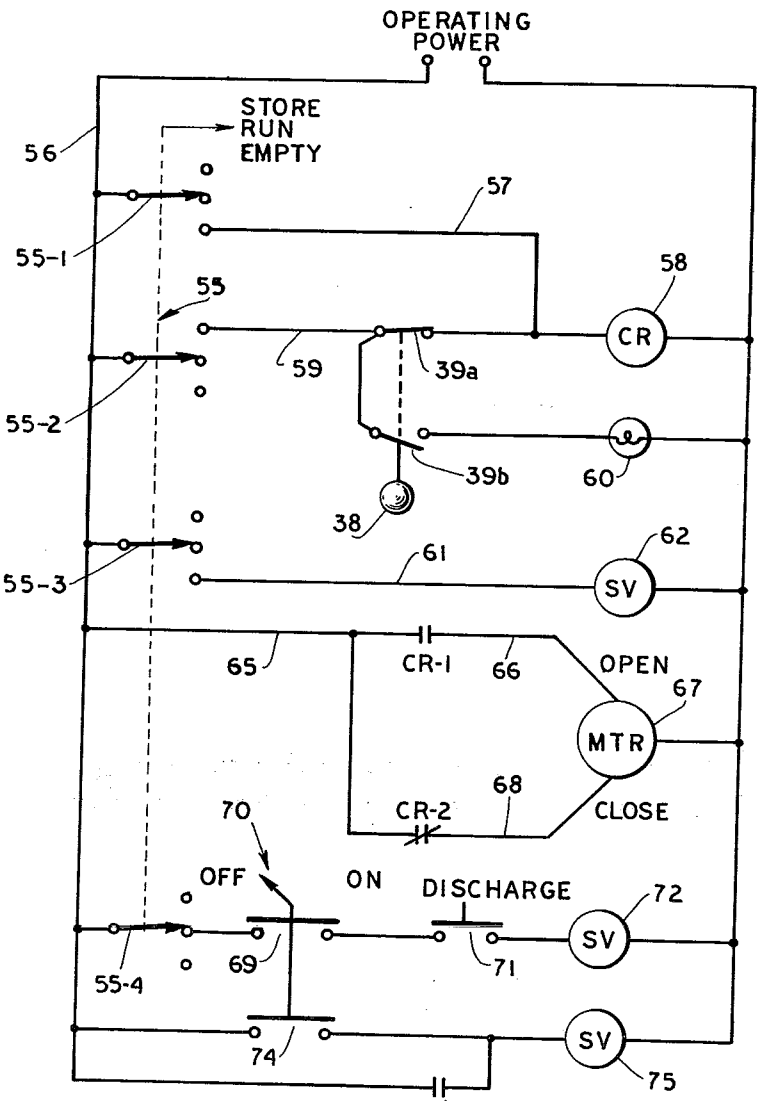
FIG. 5 is a schematic view showing control circuits used with the disclosed embodiment of the present invention.

FIG. 5 shows a schematic diagram of control circuitry for the disclosed embodiment of the present invention, although those skilled in the art will recognize that alternative types of specific control circuits may be utilized. The disclosed circuit includes a three-position mode control switch 55, which is depicted as a four-gang switch having switch positions designated "store," "run," and "empty." The several switching elements 55-1 through 55-4 of the mode control switch 55 are connected in common to one line 56 of a suitable source of operating power. The switching element 55-1, when in the "empty" switching position, establishes an operating circuit through the line 57 to energize the control relay coil 58, thereby reversing the depicted normal status of the relay contacts CR1 anad CR2.

The switching element 55-2, when in the "run" position, establishes circuit contact through the line 59 to the normally-closed contact **39*a* of the float-operated switch 39, thereby providing an alternative path for control current to the control relay coil 58. The normally-open contact 39*b* of the float-operated switch 39 is connected from the line 59 to the indicator lamp 60**.

The switching element 55-3, when in the "empty" position, applies operating power along the line 61 to the solenoid valve 62 which controls the supply of operating fluid power to the liquid sealing actuator 12. The solenoid valve 62, when not receiving operating power through the switching element 55-3 and the line 61, operates to apply fluid pressure to the actuator 32 to maintain the actuator in the elevated position shown by solid lines in FIG. 2; when the solenoid valve 62 is energized through the line 61, however, the solenoid valve applies operating fluid to the actuator 32 to lower the actuator and the liquid reservoir 30 to the position shown by broken lines in FIG. 2. Solenoid valves having the described operational characteristics are known to those skilled in the art.

A line 65 is directly connected between the line 56 and each of the aforementioned control relay contacts CR1 and CR2. The control relay contact CR1, which is normally-open when the control relay coil 58 is deenergized, is connected through the line 66 to one input circuit of a dual-action motor 67 which operates the liquid control valve 34. The normally-closed relay contact CR2 is connected through the line 68 to another input circuit of the motor 67. The motor 67, when energized through the relay contact CR1 and the line 66, operates in a manner to open the liquid control valve 34, and the motor operates to close the liquid control valve in response to being energized along the line 68 through the relay contact CR2.

The switching element 55-4, when in the "run" position, connects the line 56 to one contact 69 of the normally-open switch 70. Switch 70 may be a key-operated switch to prevent unwanted opening of the clam gate 20, and closure of the contact 69 applies power to the normally-open discharge switch 71. The discharge switch 71 is connected to the solenoid valve 72, which controls the supply of operating fluid to the gate actuator 22. The solenoid valve 72, while deenergized, maintains the gate actuator 22 in the fully-extended position shown in FIGS. 2 and 3, whereat the clam gate 20 closes the material discharge opening 19 of the storage bin. Upon being energized, however, the solenoid valve 72 supplies the gate actuator 22 with operating power causing the gate actuator to withdraw the clam gate from the aforementioned blocking position, so that material can be discharged from the bin through the opening 19.

The normally-open contacts 74 of the switch 70 are directly connected to the line 56, and selectively establish an operating circuit with the solenoid valve 75 which controls operating fluid to the actuator 18 of the storage bin vent gate **17*a*. The solenoid valve 75 operates to cause the actuator 18 to open the vent gate 17*a* only when the switch 70 is operated to energize the solenoid valve 72. An alternative circuit for energizing the solenoid valve 75 may be provided by the relay contact 73, which would be connected with additional circuits (not shown) for controlling the gate 15 at the top opening 14 of the storage bin, so that the vent gate 17***a* could be opened to vent displaced air from the bin at times when material is being fed to the bin through the top opening 14. Details of bin feeding apparatus form no part of the present invention, however, and are not discussed herein.

Considering the general operation of the embodiment as described thus far, it will be apparent that the discharge of asphalt mix (or any other material) within the storage bin 10 is selectively controlled by opening and closing of the clam gate 20. When it is desired to provide an airtight seal of the material discharge opening 19, the clam gate 20 is first moved to the closed position shown in FIG. 3, after which the liquid sealing actuator 32 is operated to elevate the liquid reservoir 30 to the raised position shown by solid lines in FIG. 2. The liquid control valve 34 is then opened, allowing liquid to flow from the reservoir 30 through the hose 33 and into the liquid receiving region 29. The liquid in the reservoir 30 may be any suitable liquid which does not damage or otherwise react with the contents of the storage bin 10; oil is a suitable liquid for use in providing an airtight seal of storage bins which contain asphalt aggregate mix.

The aforementioned liquid filling of the reservoir 30 is accomplished by placing the mode control switch 55 in the "store" position, whereupon operating power is applied through the switching element 55-2, the line 59, and the normally-closed contact 39*a* of the float-operated switch 39 to energize the control relay coil 58. The normally-open relay contact CR1 becomes closed and the normally-closed relay contact CR2 becomes open in response to energizing of the control relay coil 58, whereupon the motor 57 is energized to open the liquid control valve 34. The solenoid valve 62 associated with the liquid sealing actuator 32 is deenergized through switching element 55-3, causing the actuator 32 to raise the liquid reservoir 30 to the elevated position. Oil now flows from the reservoir 30 through the open valve 34 into the liquid receiving region 29 until the float-operated switch 38 detects the aforementioned predetermined maximum liquid level, whereupon the normally-closed switch contact 39*a* is opened and the normally-open switch contact 39*b* is closed. The control relay coil 58 is now deenergized, and the relay contacts CR1 and CR2 revert to the normal state to power the motor 67 for closing the liquid control valve 34. The indicator lamp 60 is also illuminated at this time, providing an indication that the liquid receiving region 29 in the clam gate has been filled with liquid to a predetermined maximum level. It will be understood that the level of liquid now in the region 29 of the clam gate is above the material discharge opening 19 of the bin, thereby effectively providing an airtight seal of this bin opening.

The airtight liquid seal of the material discharge opening 19 may be maintained without further action as long as desired. If the level of liquid within the liquid receiving region 29 falls to the aformentioned predetermined lower level, which is just above the elevation of the material discharge opening 19, the float-operated switch 39 provides a signal condition which again opens the liquid control valve 34, so that the level of liquid within the region 29 is automatically maintained at a level which is above the material discharge opening and which immerses the material discharge opening.

When it is desired to terminate the aforementioned liquid sealing condition, as would be done preparatory to opening of the clam gate 20, he mode control switch 55 is initially moved to the "empty" position whereupon the solenoid valve 62 is energized to cause the liquid sealing actuator 32 to lower the liquid reservoir 30 to the position depicted by solid lines in FIG. 2. At the same time, the switching element 55-2 removes power from the line 59 to the float-operated switch 39 and the switching element 55-1 supplies power to the line 57, so that the control relay coil 58 becomes energized irrespective of the float-operated switch. The liquid reservoir 30 is thus moved to the lower position and the liquid control valve 34 is opened, allowing liquid to drain from the liquid receiving region 29 of the clam gate for return to the reservoir 30. The clam gate cannot be opened at this time, however, inasmuch as the solenoid valve 72 cannot receive operating power while the switching element 55-4 is in the "empty" position.

When the liquid reservoir 30 has been maintained in the lowered position for a sufficient time to allow all liquid to drain from the region 29, the mode control switch 55 is moved to the "run" position. Power is completely removed from the control relay 58 associated with the liquid control valve 34, allowing the normally-closed contact CR2 and the motor 67 to maintain the liquid control valve 34 in the closed position. Power is also removed from the solenoid valve 62, allowing the liquid reservoir 30 to be returned to the elevated position by the liquid sealing actuator 32. No liquid flows from the liquid reservoir 30 to the liquid receiving region 29 of the clam gate, however, because the liquid control valve 34 remains closed. A circuit is now completed through the "run" position of the switching element 55-4 to the switch 70, which may be operated to the "on" position to arm an operating circuit to the discharge switch 71. When the discharge switch is closed, the solenoid valve 72 is energized and supplies operating fluid to the gate actuator 22 for withdrawal of the clam gate 20 away from the material discharge opening 19 of the storage bin. After any desired quantity of material has been discharged from the bin, the discharge switch 71 is opened and the solenoid valve 72 is deenergized to close the clam gate.

The vent gate 15 at the top of the storage bin is opened at all times when the switch 70 is in the "on" position, so that atmospheric pressure equalization is maintained in the bin while material is being discharged from the bin. The failure to equalize pressure in the bin during a typical material discharge operation develops a subatmospheric pressure within the bin which may structurally damage the bin.

It will be understood that the clam gate 20 may open and close any number of times, at the control of the discharge switch 71, without the necessity of going through a complete liquid sealing cycle as aforementioned. For example, it may be desired to establish the liquid sealing condition of the discharge opening 19 only at the end of daily operation of the storage bin, and so the mode control switch 55 would be returned to the "store" position at that time to allow liquid to flow from the elevated liquid reservoir 30 to the liquid receiving region 29 of the clam gate.

The bottom member 23 of the clam gate 20 may be heated so that the asphalt mix at the bottom of the storage bin, which is pressed against the closed clam gate, is maintained in a sufficiently plastic state to allow unimpeded opening of the clam gate. The bottom member 23 of the clam gate is heated in the disclosed embodiment by providing a pair of oil flow channels 42*a* and 42*b* preferably beneath the bottom member 23. As particularly shown in FIG. 4, the oil flow channels 42*a* and 42*b* need extend only along that portion of the bottom member 23 which is below the liquid receiving region 29 since only that portion of the bottom member is actually subject to contact by asphalt mix within the storage bin 10 when the clam gate is closed. The oil flow channels 42*a* and 42*b* are supplied with heated oil which is pumped through the oil supply line 43 from any suitable source, and which is returned for reheating by way of the oil return line 44. The supply line 43 and return line 44 preferably extend upwardly along the sides of the clam gate 20 to respective locations which are approximately in axial alignment with the mounting pivots 21*a* and 21*b* of the clam gate, so that the oil supply and return lines can be connected through rotary unions 45 and 46. It will be understood by those skilled in the art that the oil flow channels 42*a* and 42*b* of the herein-disclosed clam gate can be supplied with heated oil from the oil heating circulation system which is typically provided to supply heated oil to circulation passages (not shown) associated with the storage bin 10.

It will be understood, moreover, that the foregoing relates only to a disclosed embodiment of the present invention, and that numerous alterations and modifications may be made therein without departing from the spirit and the scope of the invention as set forth in the following claims.

What is claimed is:

1. Material storage bin with airtight discharge opening, comprising:

storage bin means for receiving material to be stored;

said storage bin means having a material discharge opening;

gate means operatively associated with said storage bin means for selectively effecting substantial material flow closure of said material discharge opening;

said gate means being selectively operative either to a closed position for effecting said substantial closure of said material discharge opening, or to an open position for opening said material discharge opening;

means defining a liquid retaining region in surrounding relation with said material discharge opening and having an uppermost region in elevated relation thereto;

liquid supply means operative independently of said gate means either to admit said liquid into said liquid retaining region in quantity sufficient to immerse said material discharge opening, or to withdraw said liquid from said liquid retaining region; and control means operatively associated with said liquid supply means to cause said liquid supply means to admit liquid into said liquid retaining means only at selected times when said gate means is in said closed position.

2. Sealing apparatus for a storage bin having a selectively closable opening for selective flow of material, comprising:

means defining a liquid receiving reservoir disposed in surrounding relation with said opening of the bin;

liquid supply means connected to said reservoir and selectively operable to admit liquid to said reservoir in an amount sufficient to immerse said opening;

said liquid supply means being selectively positionable in either an elevated position or a depressed position relative to said reservoir;

conduit means extending between said liquid supply means and said reservoir to conduct liquid from said liquid supply means in said elevated position to said reservoir, and to return liquid to said liquid supply means in said depressed position;

valve means in said conduit means; and liquid level responsive means responsive to the level of liquid in said reservoir and operatively associated with said valve means to close said valve means in response to a predetermined maximum amount of liquid in said reservoir.

3. Sealing apparatus for a storage bin having a selectively closable opening for selective flow of material, comprising:

gate means selectably positionable beneath said storage bin opening to open or to close said opening to material flow;

means on said gate means defining a liquid receiving region disposed in surrounding relation with said opening of the bin;

liquid supply means movable independently of said gate means for selectable positioning either in a raised position or in a lowered position relative to said liquid receiving region;

conduit means selectably operative to establish liquid flow communication between said liquid supply means and said liquid receiving region, so that said region can receive at least enough liquid to cover said opening; and sealing control means selectably operative to raise and lower said liquid supply means, and also selectably operative to establish gravity liquid flow communication through said conduit means only at selected times when said gate means is positioned to close said opening.

4. Apparatus as in claim 3, wherein said means defining a liquid receiving region comprises structure forming a dam which surrounds said opening and which has a maximum elevation located above said opening, so that said liquid receiving region can contain liquid at an elevation at least sufficient to immerse said opening.

5. Apparatus as in claim 3, wherein said means defining the liquid receiving region is mounted on said gate means for positioning below and in surrounding relation around said opening when said gate means is positioned beneath said opening.

6. Apparatus as in claim 5, wherein said gate means comprises a clam gate pivotally mounted for movement along an arcuate path relative to said opening, and said means defining the liquid receiving region comprises dam means mounted on said clam gate in upwardly extending relation therewith.

7. Sealing apparatus for a storage bin having a selectively closable opening for selective flow of material, comprising:

gate means selectably positionable beneath said storage bin opening to open or to close said opening to material flow;

means on said gate means defining a liquid receiving region disposed in surrounding relation with said opening of the bin;

liquid supply means operative for selectable positioning either in a raised position or in a lowered position relative to said liquid receiving region;

conduit means selectably operative to establish liquid flow communication between said liquid supply means and said liquid receiving region, so that said region can receive at least enough liquid to cover said opening;

sealing control means operative to raise and lower said liquid supply means, and also selectably operative to establish gravity liquid flow communication through said conduit means only at selected times when said gate means is positioned to close said opening; and means responsive to the amount of liquid in said liquid receiving region and operative to terminate liquid flow communication through said conduit means in response to a predetermined maximum amount of liquid in said region.

8. Sealing apparatus for a storage bin having a selectively closable opening for selective flow of material, comprising:

gate means selectably positionable beneath said storage bin opening to open or to close said opening to material flow;

means on said gate means defining a liquid receiving region disposed in surrounding relation with said opening of the bin;

liquid supply means operative for selectable positioning either in a raised position or in a lowered position relative to said liquid receiving region;

conduit means selectably operative to establish liquid flow communication between said liquid supply means and said liquid receiving region, so that said region can receive at least enough liquid to cover said opening;

sealing control means operative to raise and lower said liquid supply means, and also selectably operative to establish gravity liquid flow communication through said conduit means only at selected times when said gate means is positioned to close said opening;

motive means selectably operative to move said gate means into open and closed relation with said opening in the storage bin; and gate control means operatively associated with said motive means and with said sealing control means to prevent opening of said gate means when said storage bin opening is covered by liquid in said receiving region.

* * * * *